US006299549B1

(12) United States Patent
Shieh

(10) Patent No.: US 6,299,549 B1
(45) Date of Patent: Oct. 9, 2001

(54) STRUCTURE OF GOLF CLUB HEAD

(75) Inventor: Ji Shieh, Fengshan (TW)

(73) Assignee: Wuu Horng Industrial Co., Ltd. (TW)

( * ) Notice: Subject to any disclaimer, the term of this patent is extended or adjusted under 35 U.S.C. 154(b) by 0 days.

(21) Appl. No.: 09/454,591

(22) Filed: Dec. 7, 1999

(51) Int. Cl.[7] ..... A63B 53/04
(52) U.S. Cl. ..... 473/342; 473/345
(58) Field of Search ..... 473/324, 342, 473/329, 332, 345, 346, 349, 350, 330, 331, 131, 282, 291

(56) References Cited

U.S. PATENT DOCUMENTS 5,094,383 * 3/1992 Anderson .
5,294,037 * 3/1994 Schmidt .
5,303,922 * 4/1994 Lo .
5,433,440 * 7/1995 Lin .
5,669,829 * 9/1997 Lin .
5,704,850 * 1/1998 Shieh .
5,713,800 * 2/1998 Su .
5,816,936 * 10/1998 Aizawa .
5,871,408 * 2/1999 Chen .
5,993,329 * 11/1999 Shieh .
6,001,032 * 12/1999 Onuki .

* cited by examiner

*Primary Examiner*—Sebastiano Passaniti

(57) ABSTRACT

A golf club head formed of a hollow club head body and a face panel fastened to the rim around the front opening of the club head body, wherein the rim curves inwardly toward the center of the front opening of the club head body and defines with the face panel a filler groove around the periphery of the club head body which is filled up with a solder being welded to the club head body and the face panel, having two projecting locating rods respectively inwardly raised from the rim at two opposite sides; the face panel has two positioning side notches respectively engaged with the projecting locating rods.

2 Claims, 4 Drawing Sheets

STRUCTURE OF GOLF CLUB HEAD

BACKGROUND OF THE INVENTION

The present invention relates to a golf club head, and more particularly to such a golf club head, which is inexpensive to manufacture and, which has a high-performance face panel.

The game of golf has become more and more popular. The design of the club head determines the performance of the golf club. Various structures of golf club head have been disclosed. FIGS. 1 and 2 show a golf club head according to the prior art. This structure of golf club head is comprised of a hollow club head body 100, a face panel 200, and a top cover 300. The club head body 100 comprises a front opening 101, a top opening 103, and an inside flange 102 raised from the inside wall thereof within the front opening 101. The top cover 300 is closed on the top opening 103 and welded to the club head body 100. The face panel 200 is supported on the inside flange 102 and peripherally welded to the club head body 100 by hard soldering. The height A of the club head body 100 is about 50 mm. The wall thickness B of the club head body 100 is about 2.5 mm. The width C of the inside flange 102 is about 1.5 mm. After installation of the face panel 200 in the club head body 100, the ineffective hitting distance at the top side as well as the bottom side is B+C is about 4 mm (2.5 mm+1.5 mm=4 mm) respectively, and the effective hitting height D of the face panel 200 is A−2(B+C), i.e., about 42 mm [50−(4×2)=42]. The hitting height is greatly reduced by 16% (8÷50=0.16). Because the hitting area is greatly reduced, the player may miss the ball when hitting. Further, the welding area between the face panel 200 and the club head body 100 wear quickly with use. FIGS. 3 and 4 show another structure of golf club head. This structure of golf club head is comprised of a hollow club head body 100, a face panel 200, and a top cover 300. The club head body 100 comprises a front opening 101, a top opening 103, and an inside flange 102 raised from the inside wall thereof within the front opening 101. The top cover 300 is closed on the top opening 103 and welded to the club head body 100. The face panel 200 has a beveled peripheral edge. During the assembly process, the face panel 200 is supported on the inside flange 102, and a solder P is filled in the gap between the peripheral wall of the front opening 101 of the club head body 100 and the beveled peripheral edge of the face panel 200, enabling the face panel 200 to be welded to the club head body 100. The height A of the club head body 100 is about 50 mm. The wall thickness B of the club head body 100 is about 2.5 mm. The width C of the inside flange 102 is about 3 mm. After installation of the face panel 200 in the club head body 100, the ineffective hitting distance at the top side as well as the bottom side is B+C is about 4 mm (2.5 mm+5 mm=5.5 mm) respectively, and the effective hitting height D of the face panel 200 is A−2(B+C), i.e., about 39 mm (50−(5.5×2)=39). The hitting height is greatly reduced by 22% [(5.5×2)÷50=0.22]. Because of reduced hitting area, the player may miss the ball when hitting. Further, because the solder P is directly welded to the club head body 100 and the face panel 200 from the front side, the welding area wears quickly with the use of the golf club.

SUMMARY OF THE INVENTION

The present invention has been accomplished to provide a golf club head, which eliminates the aforesaid drawbacks. According to one aspect of the present invention, the club head body has a rim smoothly curved inwards toward the center of the front opening thereof, defining with the face panel, which is covered on the rim, a filler groove around the periphery of the club head body, and a solder is welded to the club head body and the face panel to fill up the filler groove. According to another aspect of the present invention, the club head body comprises two projecting locating rods respectively inwardly raised from the rim at two opposite sides; and the face panel comprises two positioning side notches respectively engaged with the projecting locating rods. The invention eliminates the arrangement of a top cover, and hence the manufacturing cost is greatly reduced. When welded to the club head body, the face panel has only about 4%~6% of its total area ineffective for hitting the ball. Furthermore, because the solder does not directly bear the impact when the face panel hitting the ball, the welding area does not wear quickly with the use of the golf club.

DETAILED DESCRIPTION OF THE PREFERRED EMBODIMENT

Figure 1:
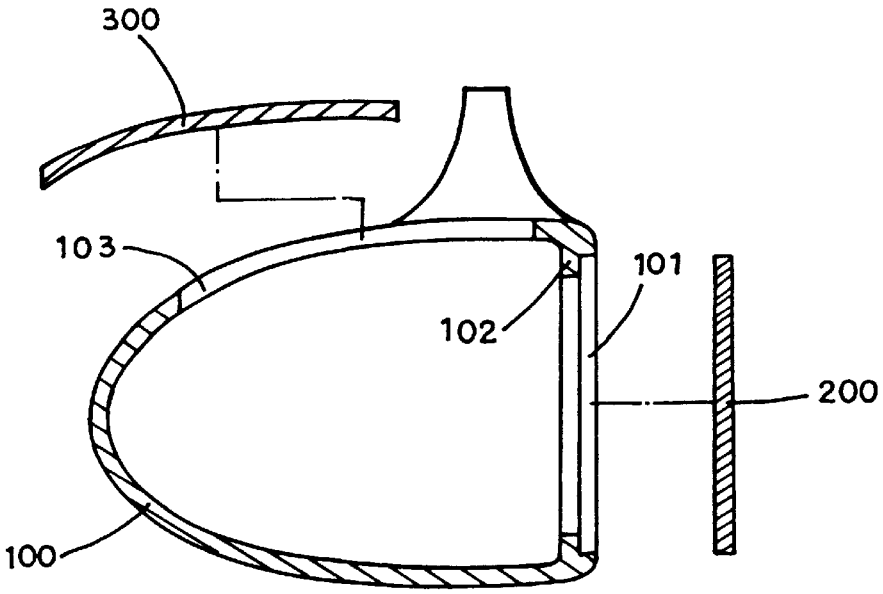
Fig.1 (Prior Art)
FIG. 1 is an exploded view in section of a golf club head according to the prior art.
Figure 2:
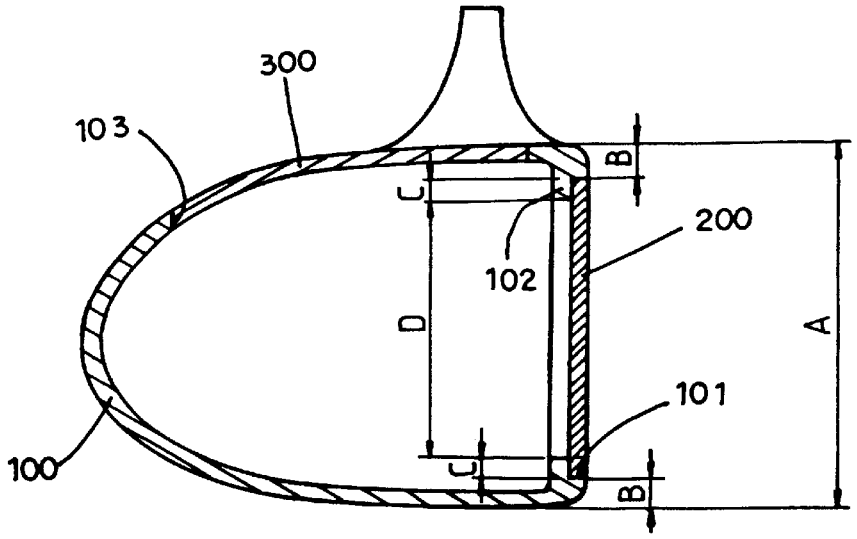
Fig.2 (Prior Art)
FIG. 2 is a sectional assembly view of the golf club head shown in FIG. 1.
Figure 3:
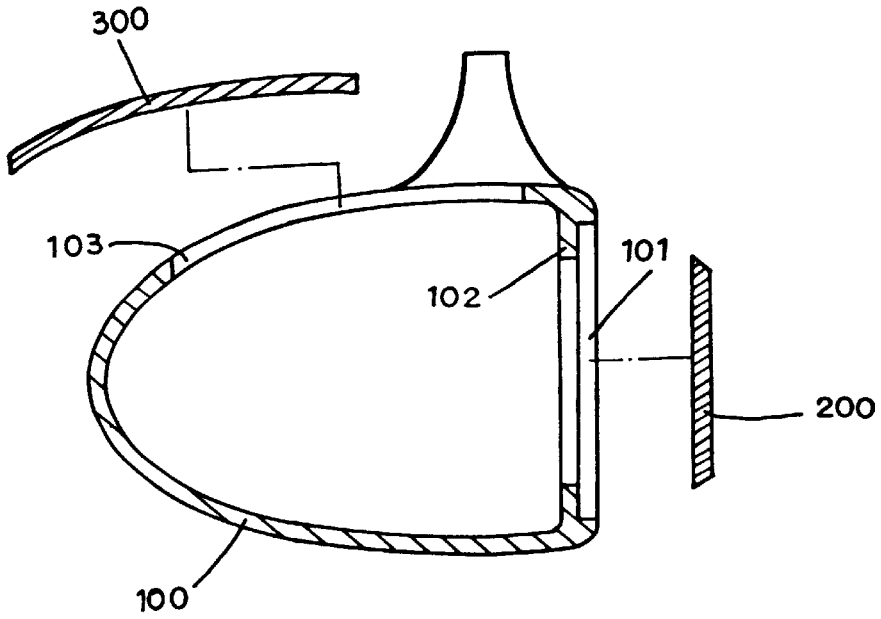
Fig.3 (Prior Art)
FIG. 3 is an exploded view in section of another structure of golf club head according to the prior art.
Figure 4:
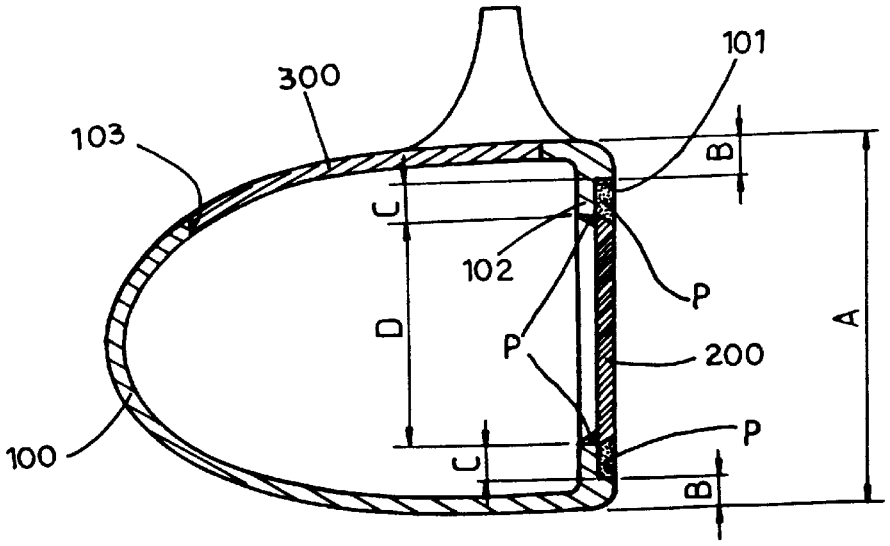
Fig.4 (Prior Art)
FIG. 4 a sectional assembly view of the golf club head shown in FIG. 3.
Figure 5:
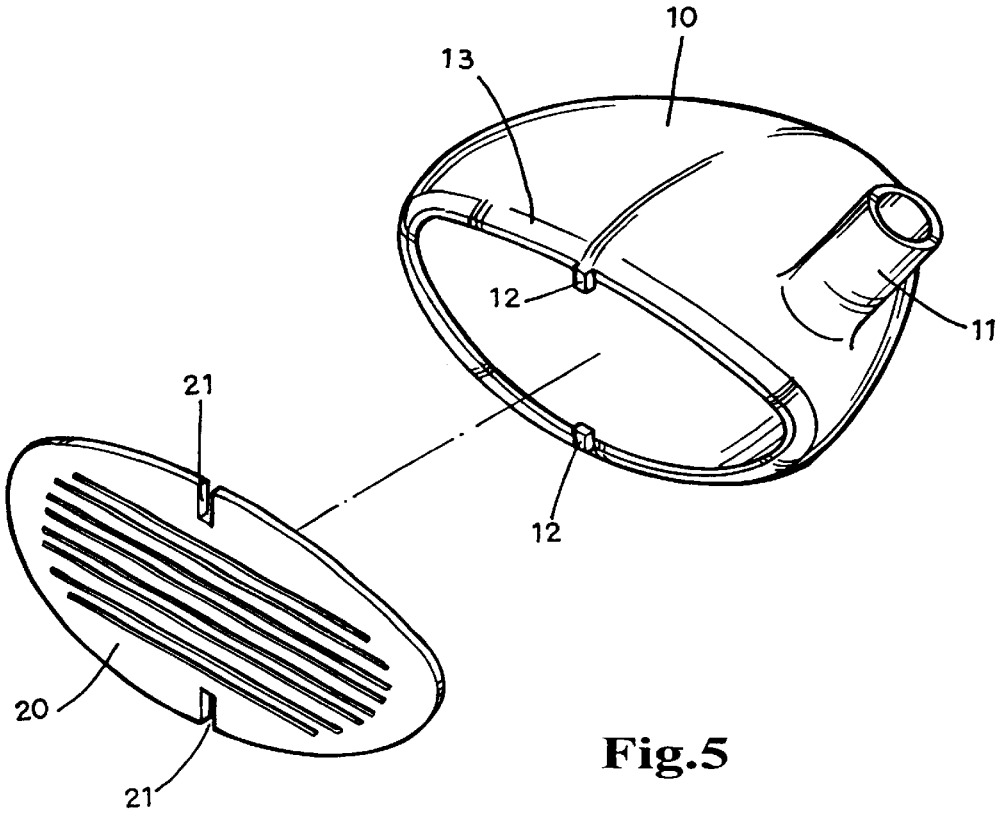
FIG. 5 is an exploded view of a golf club head according to one embodiment of the present invention.
Figure 6:
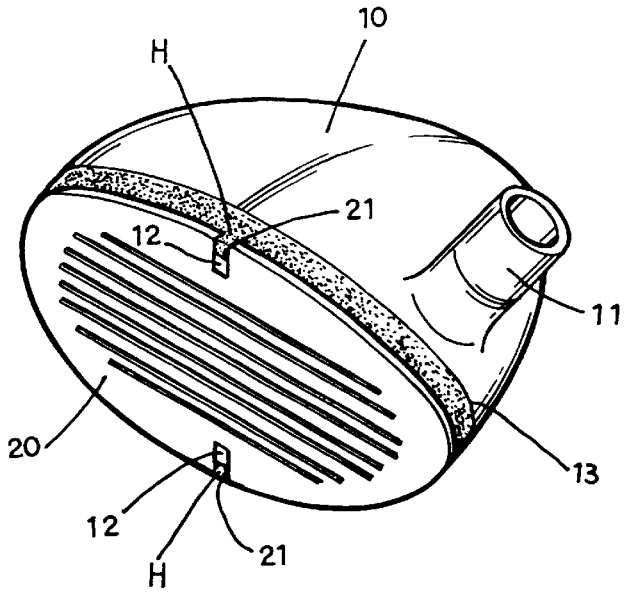
FIG. 6 is a perspective assembly view of the golf club head shown in FIG. 5.
Figure 7:
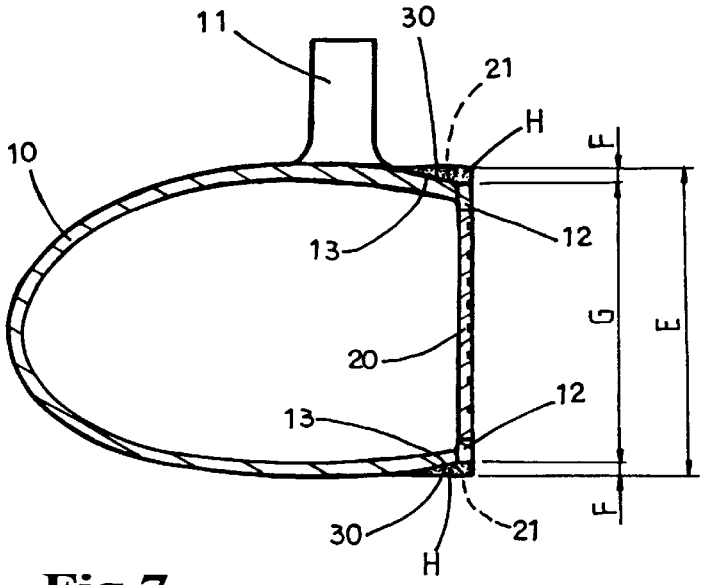
FIG. 7 is a sectional view of the golf club head shown in FIG. 6.

Referring to FIGS. from 5 through 7, a golf club head in accordance with the present invention is shown comprised of a hollow club head body 10, and a face panel 20. The club head body 10 is cast from metal, comprising a rim 13 curved inwardly toward the center of the front opening thereof, two projecting locating rods 12 inwardly raised from the rim 13 at two opposite sides and aimed at each other, and a neck 11 raised from the periphery thereof for coupling to a club shaft (not shown). The inwardly curving distance of the rim 13 is about 1 mm~1.5 mm. The face panel 20 is cast from metal and covered on the rim 13 to close the front opening of the club head body 10, having two opposite positioning notches 21 respectively forced into engagement with the projecting locating rods 12 in a flush manner (see FIG. 6). When covered on the club head body 10, the bottom sidewall of the face panel 20 defines with the rim 13 of the club head body 10 a filler groove 30 around the periphery of the club head body 10 (see FIG. 7). A solder H is soldered to the club head body 10 and the face panel 20 to fill up the filler groove 30 (see FIG. 6). After hardening of the solder H, the connecting area between the club head body 10 and the face panel 20 is polished. According to the present preferred embodiment, the height E of the club head body 10 (approximately equal to the height of the face panel 20) is about 50 mm, the depth F of the filler groove 30 (approximately equal to the inwardly curving distance of the rim 13) is about 1 mm~1.5 mm, the combined width of the soldering area at the top and bottom sides of the face panel 20 is 2F, i.e., about 2 mm~3 mm, the effective hitting height G of the face panel 20 is E−2F approximately equal to 47 mm~48 mm (50−2=48, 50−3=47) or about 4~6% (2÷50=0.04, 3÷50=0.06) less than the height E of the club head body 10. The difference between the whole area of the face panel 20 and its effective hitting area is insignificant.

Figure 8:
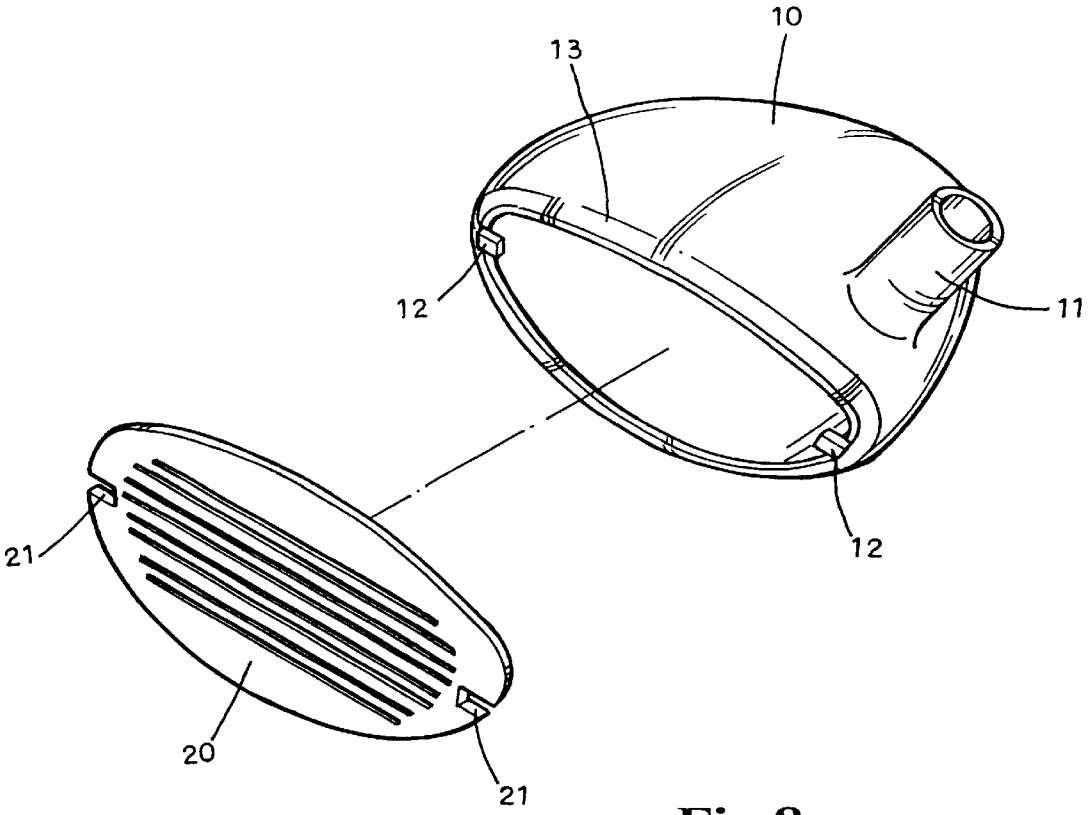
FIG. 8 is an exploded view of an alternate form of the golf club head according to the present invention.

FIG. 8 shows an alternate form of the present invention. According to the embodiment shown in FIGS. from 5 through 7, the positioning notches 21 are disposed on top and bottom sides of the face panel 20, and the projecting locating rods 12 are provided at the top and bottom sides of the club head body 10 corresponding to the positioning notches 21 on the face panel 20. According to the embodiment shown in FIG. 8, the positioning notches 21 are disposed on two opposite lateral sides, namely, the left side and the right side of the face panel 20, and the projecting locating rods 12 are respectively extended from two opposite lateral sides, namely, the left side and the right side of the rim 13 of the club head body 10 corresponding to the positioning notches 21 on the face panel 20.

It is to be understood that the drawings are designed for purposes of illustration only, and are not intended for use as a definition of the limits and scope of the invention disclosed.

What the invention claimed is:

1. A golf club head comprising a hollow club head body having a front opening and a rim around said front opening, and a face panel welded to said club head body and covered on said rim, wherein said rim curves inwardly toward the center of said front opening and defines with said face panel a filler groove around the periphery of said club head body which is filled up with a solder being welded to said club head body and said face panel, having two projecting locating rods respectively inwardly raised from said rim at two opposite sides; said face panel comprises two positioning side notches respectively engaged with said projecting locating rods.

2. The golf club head of claim 1 wherein the inward curving distance of said rim is about 1 mm~1.5 mm.

* * * * *